United States Patent [19]

Veasey

[11] Patent Number: 5,029,869

[45] Date of Patent: Jul. 9, 1991

[54] DEVICE TO KEEP GOLFER'S FOOT STABLE

[76] Inventor: Donnie O. Veasey, 5074 Old Georgetown Rd., Cleveland, Tenn. 37311

[21] Appl. No.: 575,427

[22] Filed: Aug. 30, 1990

[51] Int. Cl.[5] ..... A63B 69/36

[52] U.S. Cl. ..... 273/187 B; 273/188 A

[58] Field of Search ..... 273/32 R, 32 C, 187 B, 273/187 R, 187 A, 188 A, 188 R, 30

[56] References Cited

U.S. PATENT DOCUMENTS 4,147,356 4/1979 Brandell ..... 273/187 B 4,819,940 4/1989 Davis ..... 273/32 C

*Primary Examiner*—George J. Marlo

*Attorney, Agent, or Firm*—Cushman, Darby & Cushman

[57] ABSTRACT

A device that helps a golfer to keep the front part of her leading foot stable during a full swing shot. The device has a base with a hole in the center to allow for the passing of the cleats of a normal golf shoe. The device may thus be worn directly over a normal golf shoe. The device has special spikes mounted on one side of the base which are longer than ordinary golf shoe cleats. These special spikes help to keep the leading foot laterally stable and also help to prevent the leading foot from pivoting. The base has a strap mounted on the side opposite that of the special cleats, for holding the device to a golf shoe, or other type of shoe such as a dress shoe or tennis shoe.

13 Claims, 2 Drawing Sheets

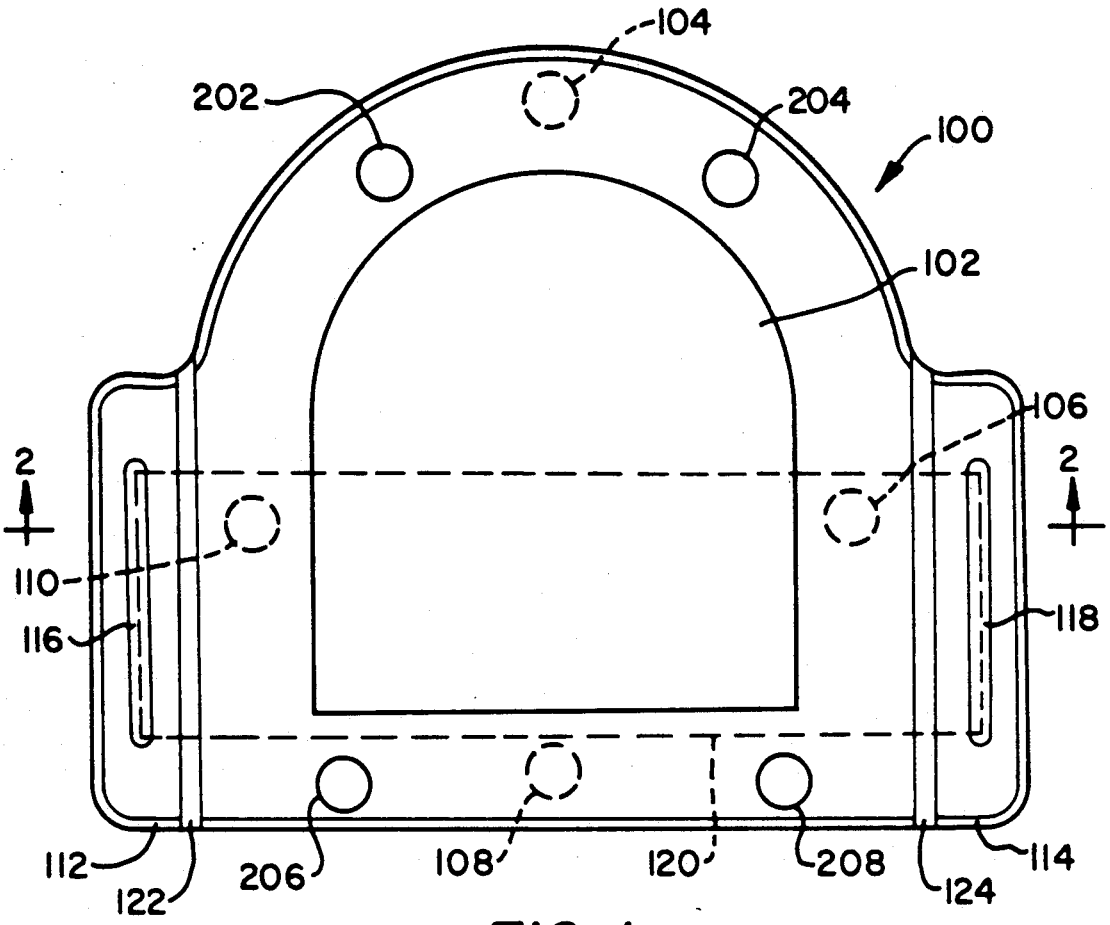
FIG. 1
FIG. 2
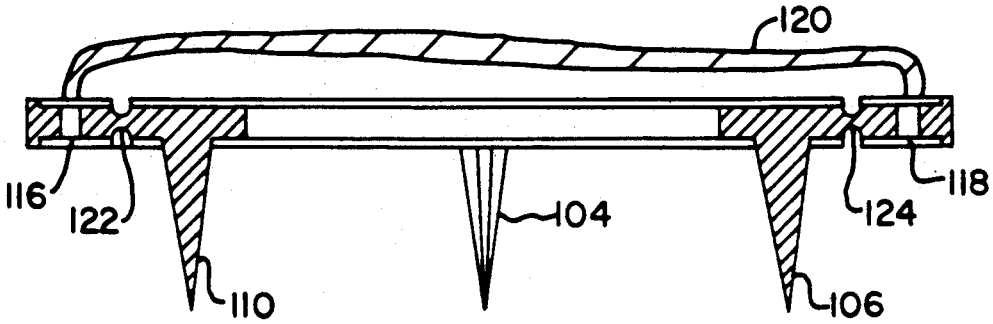

118
114
124
100
128
126
134
132
130
110
140
100

DEVICE TO KEEP GOLFER'S FOOT STABLE

BACKGROUND AND SUMMARY OF THE INVENTION

The present invention relates to a device for holding a golfer's leading foot stable during a golf swing, especially when the golfer is driving the ball (the leading foot is the left foot for a right-handed golfer). The golfing community has recognized the importance of stability of the front part of the leading foot for proper shifting of weight during the hitting motion. A stable leading foot allows the golfer to address the ball correctly and to drive the ball farther than if the golfer moves the front part of his leading foot during the swing.

The present invention defines a device that keeps the golfer's leading foot in place by providing a device that attaches to the normal golf shoe and enables better stability of the foot through the use of extra spikes. These spikes are arranged not only to prevent lifting of the front part of the leading foot during the swing, but also to prevent twisting or pivoting of the front part of the leading foot. In its envisioned use, the device attaches to the golfer's foot over the golf shoe, in a manner that does not interfere with the existing cleats. As a result, the golfer can easily and conveniently attach and detach the device. The owner of the device may wear it over any type of shoe, however, such as dress shoes, tennis shoes, etc. Thus, the purchaser of the device need not own a pair of cleated golf shoes in order to use the device.

BRIEF DESCRIPTION OF THE DRAWING FIGURES

These and other aspects of the invention will now be described in detail with reference to the accompanying drawings, wherein:

FIG. 1 shows a top view of the invention.

FIG. 2 shows a forward looking cross-sectional view of the invention, along line 2—2 of FIG. 1.

DETAILED DESCRIPTION OF THE PREFERRED EMBODIMENT

Figures 3, 4:
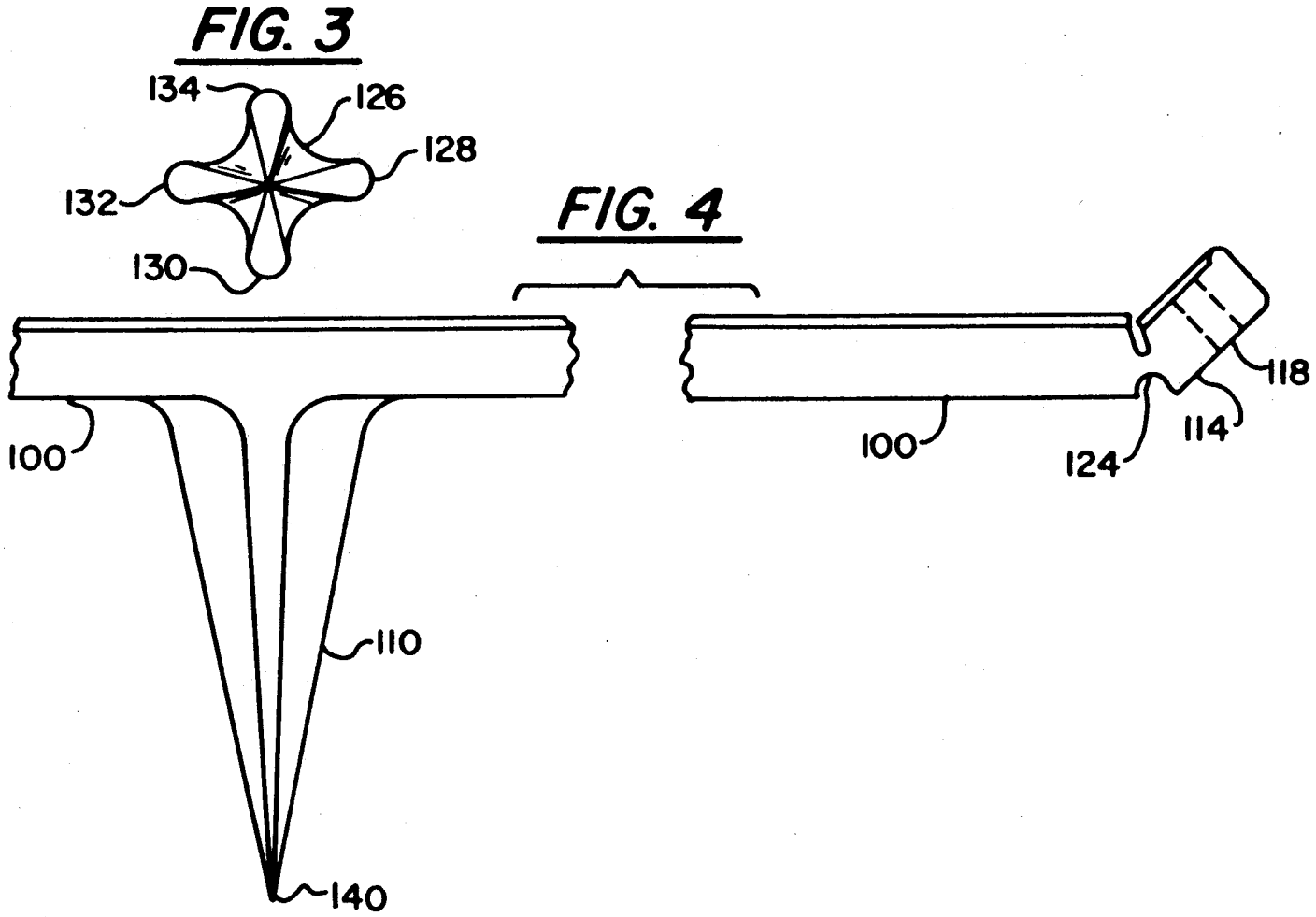
FIG. 3 shows one of the spikes of the device from the bottom.
FIG. 4 is an enlarged picture of the spike, flange, and connection portions of the present invention.

The structure of the invention will be described starting with FIG. 1. The base 100, made of plastic, is designed with a hole 102 in the center, allowing the passage of the cleats of a normal golf shoe. Four special spikes, 104, 106, 108, and 110, are mounted on the base. These spikes are longer than the normal cleats of a golf shoe—they are approximately 1" long while ordinary cleats are from ⅛" to ⅜" long. The spikes have a special design that allows them to sink easily into the ground and to hold the ground firmly once planted. FIG. 3 shows the preferred shape of the spike including four lobes (128, 130, 132, 134) which are joined together by plastic webbing (126) and which taper to a point (see 140 of FIG. 4). The spike is extremely strong and stable and as a result passes more easily into the ground. Furthermore, since the cross-section of the spike broadens as it sinks into the earth, it is more effective than a non-tapered spike in anchoring the foot to the ground.

In addition to the spikes, the base has two outer flanges, 112 and 114. The flanges have two slots, 116 and 118 (see FIGS. 1, 2 and 4), which serve to hold a fastening means, 120, in place. The fastening means may be any device appropriate to holding the base 100 to a shoe—for example, a leather strap with buckle, a series of laces, or, in the preferred embodiment, a Velcro strap. If a Velcro strap is used, there will be provided enough "attaching surface" to allow the device to be strapped onto any golf shoe, despite the size. The device may also be worn over normal tennis shoes, dress shoes, or the like.

The flanges 112 and 114 are attached to the base by flexible pieces 122 and 124 (see FIGS. 1,2, and 4). These pieces are made of the same plastic material as the base, but because they are thinner than the base, they allow the flanges to fold up on either side of the golf shoe when the Velcro strap is pulled tight. This ensures a snug fit between the base and shoe.

The inventors recognize that certain golf shoe makers use cleat patterns which are different from the majority of shoes. Thus, extra holes (202, 204, 206, 208) are provided in the base, and these extra holes allow the base to fit special golf shoe cleat patterns by allowing cleats to pass which would otherwise contact the base. With these holes, the inventors envision that their product can be worn on almost any type of golf shoe. The operation of the device will now be described.

When the golfer is practicing his swing, he wears the device over the golf shoe of his leading foot. The added cleats help to keep the front part of the leading foot from shifting laterally during the swing, while allowing the heel of the leading foot to rise. In addition, the device prevents the leading foot from pivoting axially due to the arrangement of the four cleats on the base. The device keeps the leading foot stable which allows proper weight shift and greater force when driving the ball.

The weight and presence of the device on the golfer's foot further serves as a mental reminder to the golfer to keep his foot still. Eventually, the golfer will learn the proper stance, at which time the golfer should be able to strike the ball without using the device. The device is therefore a trainer to be used until the golfer achieves the correct stance.

Although the specification has dealt with particular attention to the device's utility during the driving swing, the applicants envision its use during most full swing golf shots. Thus the device has utility when the golfer makes his approach shots to the green, when he makes pitch shots, and when he makes other full swing shots.

Although only a few embodiments have been described in detail above, those having ordinary skill in the art will certainly understand that many modifications are possible in the preferred embodiment without departing from the teachings thereof. For instance, the spikes could be plain nails or screws or any other pointed elements. The base could be a metal sheet, and the hinges, while desireable, are not absolutely essential.

All such modifications are intended to be encompassed within the following claims.

I claim:

1. A device for holding a golfer's leading foot stable during a golf swing, the device comprising:

a base with a hole in the center to allow for the passage of the cleats of a golf shoe, a plurality of pointed elongated protrusions attached to a first side of the base and extending away from the first side of the base, the protrusions being arranged in a pattern on the base so as to prevent axial rotation of the base when the protrusions are planted into a surface, and fastening means for holding the golfer's leading foot to the base while the cleats of the golfer's shoe are located in said center hole.

2. A device as claimed in claim 1 wherein the fastening means for holding the leading foot to the base comprises a strap.

3. A device as claimed in claim 2, wherein the base has flange portions attached to its periphery and slots located in the flange portions, and the strap is attached to the base by passing it through the slots in the flange portions.

4. A device as claimed in claim 3, further comprising flexible members which connect the flange portions to the base.

5. A device as claimed in claim 1, wherein the elongated protrusions are formed by four lobes joined together which taper along their entire length to form a point, such that the cross-sectional width of the end of the protrusion which attaches to the base is wider than the cross-sectional width of any other portion of the protrusion.

6. A device as claimed in claim 5, wherein the base has a plurality of additional holes to provide for the passing of the cleats of a golf shoe which employs cleats which would otherwise contact the base portion.

7. A device for holding a golfer's leading foot stable during a golf swing, the device comprising:

a base having an outer perimeter which is in the shape of the front part of a shoe, and also having inner surfaces within which a hole is defined in the center of the base, the hole sized to allow for the passing of cleats associated with a cleated golf shoe without interfering with the normal function of the cleats of the golf shoe, the base including a shoe abutting surface adapted to abut directly against the bottom of a golf shoe, and a ground abutting surface adapted to abut against the ground, a plurality of elongated ground engaging protrusions coupled to the ground abutting surface of the base and extending away from the ground abutting surface of the base, the protrusions being arranged in a pattern on the base so as to prevent axial rotation of the base when the protrusions are planted into a surface, and a strap attached to the base for holding the leading foot to the base, wherein the strap has fixed thereon a surface for securing the base to the foot.

8. A device for holding a golfer's leading foot stable during a golf swing, the device comprising:

a base in the shape of a front part of a shoe, with a hole in the center of the base, the hole sized to allow for the passing of cleats associated with a golf shoe so that the base may be worn directly over a golf shoe without interfering with the normal function of the cleats of the shoe, a plurality of pointed elongated protrusions attached to a first side of the base and extending away from the first side of the base, the protrusions being arranged so as to prevent axial rotation of the base when the protrusions are planted into a surface, and fastening means for holding the leading foot to the base.

9. A device as claimed in claim 8, wherein the fastening means for holding the leading foot to the base comprises a strap.

10. A device as claimed in claim 9, wherein the base has flange portions attached to its periphery and slots located in the flange portions, and the strap is attached to the base by passing it through the slots in the flange portions.

11. A device as claimed in claim 10, further comprising flexible members which connect the flange portions to the base.

12. A device as claimed in claim 8, wherein the elongated protrusions are formed by four lobes joined together which taper along their entire length to form a point, such that the cross-sectional width of the end of the protrusion which attaches to the base is wider than the cross-sectional width of any other portion of the protrusion.

13. A device as claimed in claim 12, wherein the base has a plurality of additional holes to provide for the passing of the cleats of a golf shoe which employs cleats which would otherwise contact the base portion.

* * * * *

UNITED STATES PATENT AND TRADEMARK OFFICE

CERTIFICATE OF CORRECTION

PATENT NO. : 5,029,869

DATED : July 9, 1991

INVENTOR(S) : Donnie Q. VEASEY

It is certified that error appears in the above-identified patent and that said Letters Patent is hereby corrected as shown below:

On the title page;

Please change

"(76) Inventor: Donnie O. Veasey . . . ."

to --(76) Inventor: Donnie Q Veasey . . . .--

Signed and Sealed this

Twenty-second Day of December, 1992

*Attest:*

DOUGLAS B. COMER

*Attesting Officer*

*Acting Commissioner of Patents and Trademarks*